US007610909B2

(12) United States Patent
Greene, Jr.

(10) Patent No.: US 7,610,909 B2
(45) Date of Patent: Nov. 3, 2009

(54) SYSTEM AND METHOD FOR CONTROLLING A SPORTS OBJECT THROWING MACHINE

(75) Inventor: William James Greene, Jr., La Canada, CA (US)

(73) Assignee: Sports Tutor, Inc., Burbank, CA (US)

( * ) Notice: Subject to any disclaimer, the term of this patent is extended or adjusted under 35 U.S.C. 154(b) by 393 days.

(21) Appl. No.: 11/624,477

(22) Filed: Jan. 18, 2007

(65) Prior Publication Data

US 2008/0173288 A1 Jul. 24, 2008

(51) Int. Cl.
*F41B 4/00* (2006.01)

(52) U.S. Cl. ..... 124/78

(58) Field of Classification Search ..... 124/6, 124/78

See application file for complete search history.

(56) References Cited

U.S. PATENT DOCUMENTS

| | | | | |
|---|---|---|---|---|
| 3,989,245 | A | 11/1976 | Augustine, Jr. et al. | |
| 4,025,071 | A | 5/1977 | Hodges | |
| 4,046,131 | A | 9/1977 | Clark et al. | |
| 4,233,953 | A | 11/1980 | Bash | |
| 4,269,163 | A | 5/1981 | Feith | |
| 5,125,653 | A * | 6/1992 | Kovacs et al. | 124/78 |
| 5,490,493 | A | 2/1996 | Salansky | |
| 5,649,523 | A | 7/1997 | Scott | |
| 6,026,798 | A | 2/2000 | Sanders et al. | |
| 6,082,350 | A | 7/2000 | Crews et al. | |
| 6,085,735 | A | 7/2000 | Cheek, Jr. | |
| 6,443,141 | B2 | 9/2002 | Battersby | |
| 6,672,298 | B2 | 1/2004 | Battersby et al. | |
| 2004/0261778 | A1 * | 12/2004 | Wilmot | 124/78 |
| 2005/0032581 | A1 | 2/2005 | Wagner | |
| 2005/0172943 | A1 * | 8/2005 | Cucjen et al. | 124/6 |
| 2006/0236993 | A1 | 10/2006 | Cucjen et al. | |

* cited by examiner

*Primary Examiner*—John Ricci
(74) *Attorney, Agent, or Firm*—Woodard, Emhardt, Moriarty, McNett & Henry LLP

(57) ABSTRACT

A system and method for controlling a sports object throwing machine is disclosed that utilizes preprogrammed parameters of shot distribution pattern, throwing speed, feed rate, elevation, spin rate and direction to permit operation of the sports object throwing machine by simply selecting a skill level. Adjustment keys are provided to allow user customization of the operating parameters as desired. In addition, the preprogrammed parameter of shot distribution pattern includes instrumentality to reduce repetitive shots to the same location by reducing the comparative probability of subsequent shots to the same location.

29 Claims, 8 Drawing Sheets

SYSTEM AND METHOD FOR CONTROLLING A SPORTS OBJECT THROWING MACHINE

TECHNICAL FIELD

The present disclosure relates in general to the field of sports object delivery devices and, more particularly, to devices, systems and methods for controlling sports object throwing devices.

BACKGROUND

The present disclosure relates to an apparatus and method for controlling a ball or other sports type object throwing machine, such as a tennis ball machine.

Sports object throwing machines may be utilized to simulate some aspect of a particular sport for the purpose of practice. For example, simulation of an opponent by a tennis ball machine may permit a player to practice return skills. As another example, a baseball or softball pitcher can be simulated by a pitching machine to permit a batter to practice their batting skills. Alternatively, a baseball throwing machine can be used to simulate a hitter so that players can practice fielding skills.

However, heretofore in this field, the control of automatic sports object throwing machines such as tennis or baseball machines have been limited by either being too simplistic to provide a complete training experience or too complex to be easily usable. The methods of controlling such sports object throwing machines are varied. In some cases, few controls are supplied, requiring manual adjustments of the equipment by the user to manual adjust the equipment to provide the desired throwing characteristics such as position, speed, spin, etc. In other examples, complex computerized controls requiring substantial user programming are provided. Requiring a user to program the sports object throwing machine with complex inputs may reduce the user's satisfaction with the equipment due to the amount of set up time required. Furthermore, in some situations a user will not be capable of fully utilizing machine capacities if they are unable to adequately program such equipment.

Another consideration is that while simulating some aspect of a particular sport for the purpose of practicing the sport, such as tennis, it is desirable to not only throw the sports object in a particular way, but also to vary the distribution of successive throws to provide a more complete practice experience for the user. In this regard, some existing tennis ball machines provide means for distributing shots to different locations on the tennis court. One example of such a means is found in the LOBSTER ELITE TWO, produced by Lobster Sports, Inc., 7340 Fulton Ave, North Hollywood, Calif. 91605. This tennis ball machine utilizes horizontal and vertical oscillation functions to throw balls throughout the entire court area. However, such use of oscillation functions makes such equipment predictable to the user and thus may provide inadequate training of the skills related to reacting to and running down a ball shot to an unexpected location.

Another control means is found in U.S. Pat. No. 5,125,653 which provides a control wherein the stroke parameters including the impact point, the training level and the stroke type are loaded for every stroke one by one into the program memory. A user may then execute the stored program in a mixed manner by pressing a key. As previously discussed, requiring a user to program a controller in such a way may be time consuming. In addition, this method simply randomizes the various stroke parameters. Such randomization does not provide an accurate representation of actual shot distributions in a competitive tennis game where the majority of shots are likely to be located at deep center court, and thus simple randomization of shot location may not provide an optimum training experience.

SUMMARY

One form of the disclosure pertains to an apparatus for throwing sports objects which comprises: a throwing machine; and a controller that controls the location of throws by the throwing machine, wherein the probability of a throw being made to a particular location is affected by the randomly selected location of a prior throw.

Another form of the disclosure pertains to a method of operating a sports object throwing machine which comprises the steps of: a) providing a sports object throwing machine comprising: a throwing machine having operating parameters; a controller that controls the operating parameters of the throwing machine; a skill level selector; and a plurality of preprogrammed throw distribution patterns, wherein each of the plurality of different preprogrammed throw distribution patterns correspond to skill levels selectable by the selector; b) selecting a skill level with the skill level selector; and c) upon the selection of the skill level, automatically setting within the controller the throw distribution pattern which corresponds to the selected skill level.

Yet another form of the disclosure pertains to an apparatus for throwing sports objects which comprises: a sports object throwing apparatus having operating parameters; a controller that controls the location of throws by the sports object throwing apparatus; a selector for selecting a skill level; and a plurality of preprogrammed probabilities for controlling the location of throws by the sports object throwing apparatus, wherein each of the plurality of preprogrammed probabilities correspond to individual skill levels selectable by the selector; wherein upon the selection of the skill level, the probabilities for controlling the location of throws by the sports object throwing apparatus corresponding to the selected skill level are automatically set in the controller.

Still another form of the disclosure pertains to a ball-throwing machine for throwing tennis balls that consists essentially of: a tennis ball throwing mechanism having adjustments for throwing elevation and horizontal angle; a skill level selector operable for a user to select one of a plurality of skill levels; and a controller operable to control the throwing elevation and horizontal angle, said controller being programmed with standard probability parameters for throwing elevation and horizontal angle for each of the plurality of skill levels, wherein upon selection of one of the plurality of skill levels by the user, the controller sets the parameters of throwing elevation and horizontal angle on the basis of the standard programmed probability parameters corresponding to the selected skill level and then begins repetitive operation of the tennis ball throwing mechanism on the set probability parameters of throwing elevation and horizontal angle.

DETAILED DESCRIPTION

Figure 1A:
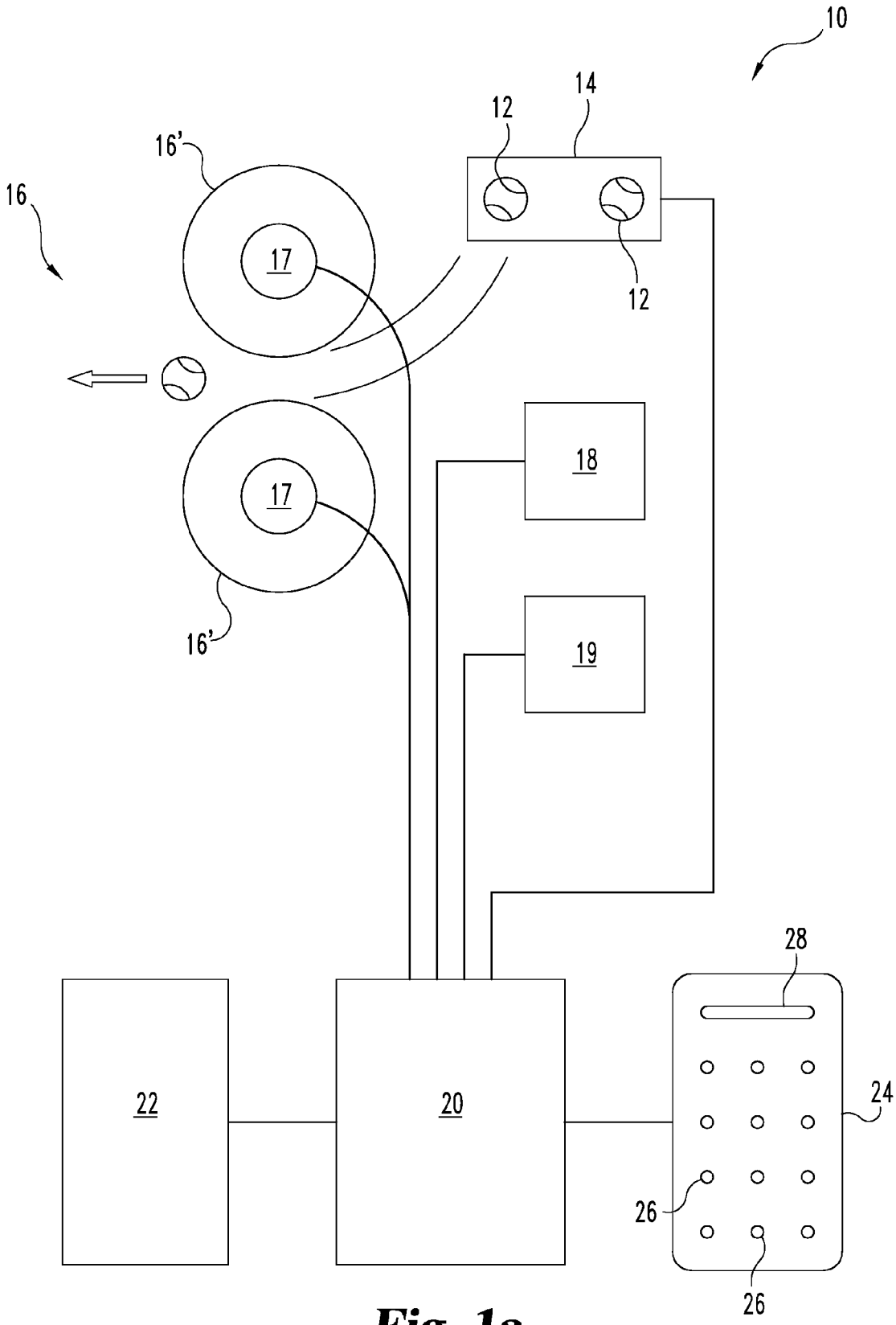
FIG. 1*a* is an illustration of an embodiment of the sports object throwing system of the present disclosure.

While the present disclosure may be embodied in many different forms, for the purpose of promoting an understanding of the principles of the present disclosure, reference will now be made to the embodiments illustrated in the drawings, and specific language will be used to describe the same. It will nevertheless be understood that no limitation of the scope of the disclosure is thereby intended. Any alterations and further modifications in the described embodiments and any further applications of the principles of the present disclosure as described herein are contemplated as would normally occur to one skilled in the art to which the disclosure relates.

We find now in FIG. 1*a* an illustration of system 10 corresponding to a sports object throwing machine in accordance with an embodiment of the present disclosure. System 10 includes sports object 12, feed controller 14, throwing means 16, wheels 16', speed control means 17, horizontal adjustment means 18, vertical adjustment means 19, controller 20, controller program 22 and controller inputs 24. Sports object 12 could be, by way of nonlimiting example, one or more of the following: a baseball, a softball, a tennis ball, a cricket ball, a racquet ball, a hand ball, a shuffle board puck, a volleyball, a dodge ball, a rugby ball, a football, a badminton shuttlecock, a field hockey puck, an ice hockey puck, a lacrosse ball, or a soccer ball. Feed controller 14 can be of any form known to those skilled in the art and feed controller 14 preferably provides a means for controlling the rate or time at which sports objects are thrown by throwing means 16. Non-limiting examples of feed controllers 14 are found in the prior art as follows. U.S. Pat. No. 4,834,060, to Greene, discloses a ball indexing ball feeder having an ball feeding rotor. U.S. Pat. No. 5,125,653 to Kovács et al., discloses a ball feeder, illustrated in FIG.2 of that patent, which utilizes a piston to feed balls.

Throwing means 16 is illustrated comprising a pair of vertical revolving wheels 16' as is known in the art. However, throwing means 16 could be any mechanism known for throwing a sports object as is known to those skilled in the art. By way of non-limiting example, throwing means 16 could comprise a rotary pitching arm, one or more rotating wheels, a pneumatic pressure device, or any other means known to those skilled in the art. An example of one throwing means 16 can be found in U.S. Pat. No. 4,834,060 to Greene, the inventor of the present disclosure, utilizes a pair of ball throwing wheels to throw tennis balls. Another example is found in U.S. Pat. No. 3,989,245 to Augustine, Jr. et al., which discloses a pneumatic tennis ball delivery mechanism. Yet another example is found in U.S. Pat. No. 6,637,418 to Suba et al., which discloses a spring-actuated arm mechanism baseball pitching machine. Similarly, speed control means 17 is in the appropriate form to control the particular throwing means 16, as is known in the art. In the embodiment illustrated in FIG. 1*a*, speed control means 17 preferably controls the rotational speed of wheels 16'. In the preferred embodiment, the speed of wheels 16' are controlled independently to facilitate throwing sports object 12 with variable spin rate and direction to control the magnitude and direction of any spin imparted to sports object 12 by throwing means 16.

Horizontal adjustment means 18 includes means to adjust the operating parameters of throwing means 16 including, but not limited to, side-to-side positioning of throwing means 16, or alternatively, the side-to-side angling of the throwing or a combination of the two. Vertical adjustment means 19 includes means to adjust the operating parameters of throwing means 16 including, but not limited to, up and down positioning of the throwing means, or alternatively of the vertical angle of the throwing means or a combination of the two. Depending on the desired effect, some or all of these parameters may be adjustable. Adjustment means 18 and 19 can be of conventional design as is known to those in the art.

Throwing means 16, speed control means 17, horizontal adjustment means 18 and vertical adjustment means 19 are controlled by controller 20. Controller 20 is preferably a microprocessor controller as known to those skilled in the art. Program 22 contained within controller 20 provides a database of operating parameters, including control of throwing means 16, speed control means 17, horizontal adjustment means 18, vertical adjustment means 19 and feed controller 14. Input panel 24 provides a means for user input to the controller utilizing selectors 26 to input various parameters into the controller such as skill level, throwing speed, throwing elevation, spin rate and feed rate among other examples that may be required for particular throwing means as would be known to those skilled in the art. Controller 20 converts the inputted parameters into operating parameters for control of throwing means 16, speed control means 17, horizontal adjustment means 18, vertical adjustment means 19 and feed controller 14 as appropriate. Display 28 provides feedback to the user of selected or programmed parameters. Display 28 may be a numeric or scaled display LED, indicator lights, a liquid crystal screen, a CRT or any other display means known in the art.

Figure 1B:
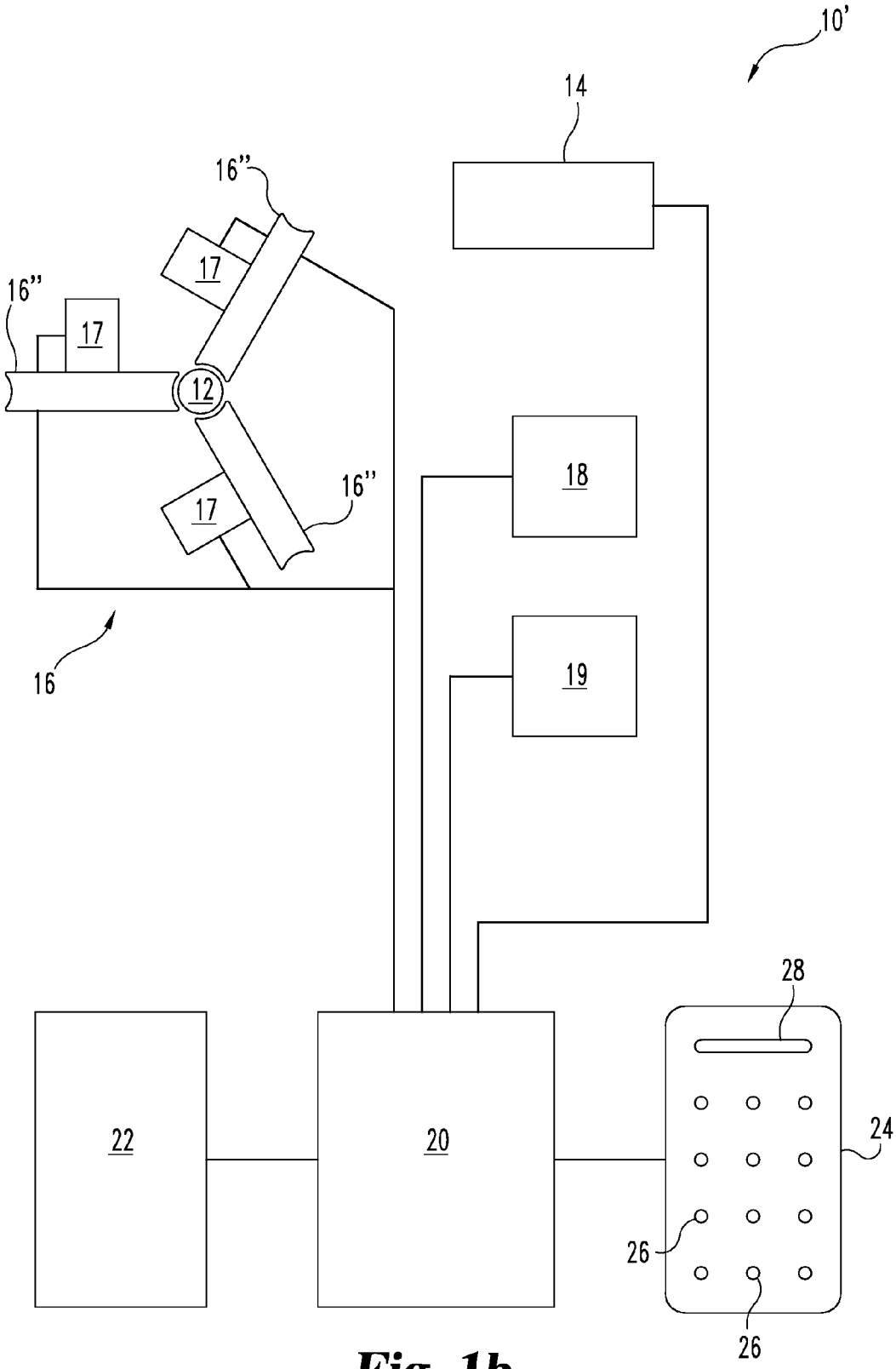
FIG. 1*b* is an illustration of an alternate embodiment of the sports object throwing system of the present disclosure.

Referring now to FIG. 1*b*, an alternate embodiment of system 10 is illustrated as system 10'. System 10' includes sports object 12, feed controller 14, throwing means 16, wheels 16", speed control means 17, horizontal adjustment means 18, vertical adjustment means 19, controller 20, controller program 22 and controller inputs 24. For simplicity, the same reference numerals have been used to describe elements having the same function as described for system 10 illustrated in FIG. 1*a*. The relationships between the elements illustrated in FIG. 1*b* are the same as the relationships between elements illustrated and described in FIG. 1*a* unless noted otherwise herein.

In system 10', throwing means 16 is illustrated comprising three revolving wheels 16" as is known in the art. A non-limiting example of a three wheel baseball throwing machine is found in U.S. Pat. No. 5,649,523 to Scott. Such a design allows a variety of spin axis orientations by varying the comparative speeds of one or more of wheels 16" as is known to those in the art. While system 10 is illustrated utilizing a two wheel throwing machine and system 10' is illustrated utilizing a three wheel throwing machine, numerous other designs could be chosen as well for the ball throwing device, including, among others, pneumatic or swinging arm devices, as are known in to those the art of throwing machines. In the embodiment illustrated in FIG. 1*b*, speed control means 17 preferably controls the rotational speed of wheels 16". In one embodiment, the speed of wheels 16" are controlled independently to facilitate throwing sports object 12 with variable spin rate and spin axis to control the magnitude and axis of any spin imparted to sports object 12 by throwing means 16.

In any event, and irrespective of the type of throwing machine utilized with the control system described herein, the parameters of speed, horizontal position and/or angle, vertical position and/or angle, spin rate, spin axis and feed rate or interval are preferably controlled by controller 20.

Figure 2:
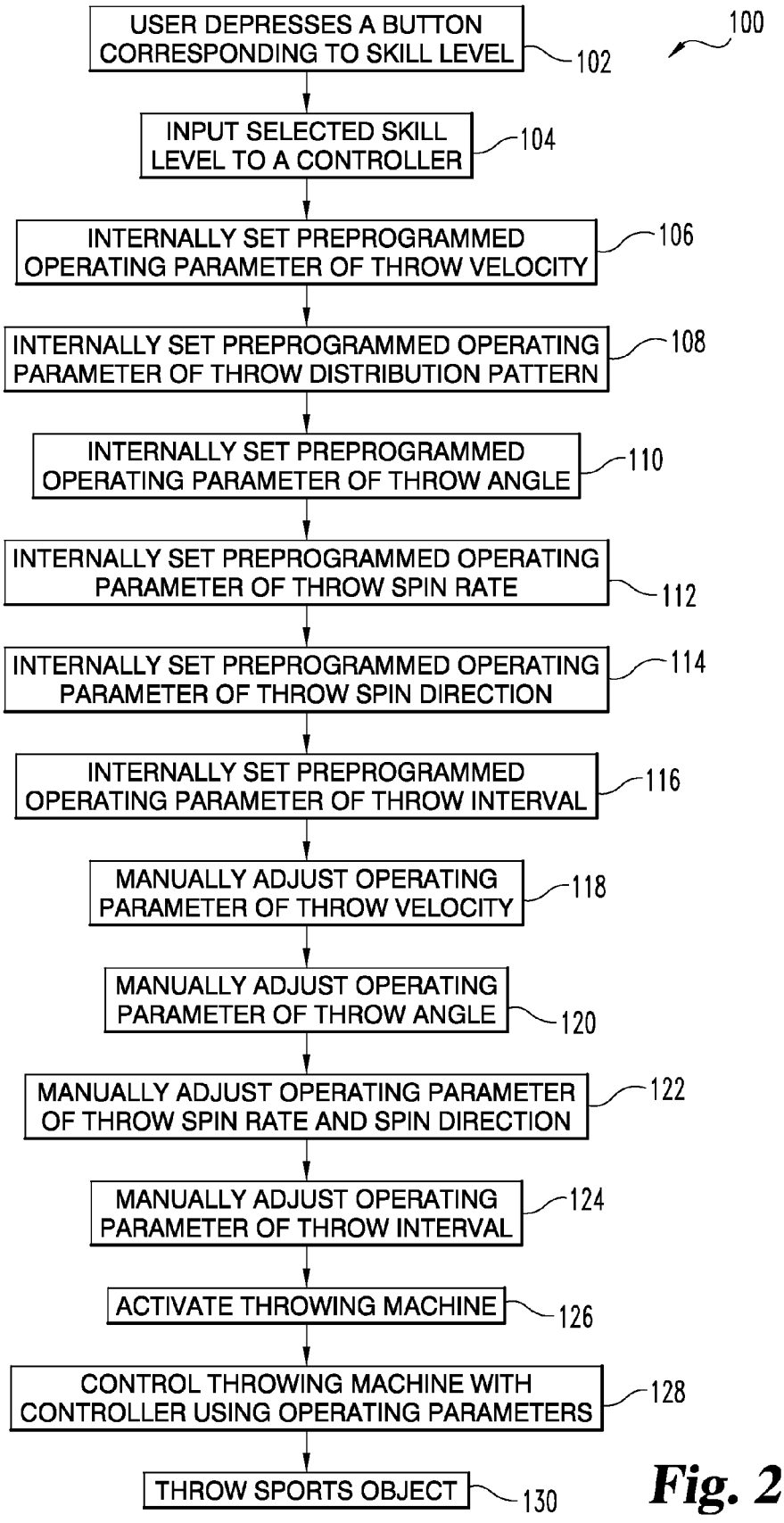
FIG. 2 is a flow diagram of an embodiment of the method of the present disclosure.

Referring now to FIG. 2 an embodiment of a process of controlling a sports object throwing machine is depicted in flow chart form as procedure 100. Procedure 100 begins with step 102 wherein a user depresses a button on the controller corresponding to the player skill level desired to be simulated. In one embodiment, the controller has a selection of three skill levels—beginner, intermediate or advanced, as detailed below. Next, procedure 100 proceeds to step 104 where the selected skill level is inputted to the controller. Procedure 100 continues with steps 106, 108, 110, 112, 114 and 116 wherein the operating parameters of throw velocity, throw distribution pattern, throw angle, throw spin rate, throw spin direction, and throw interval or feed rate are internally set in the controller based on pre-programmed operating parameters on the basis of the inputted skill level. Procedure 100 then proceeds to steps 118, 120, 122 and 124 wherein the user can manually adjust the operating parameters of throwing velocity, throwing angle, spin rate, spin direction and throwing interval or speed rate using manual adjustment buttons. In a preferred embodiment, such manual adjustment overrides preset parameters being adjusted while the other pre-programmed operating parameters are maintained. Procedure 100 continues with step 126 where the throwing machine is automatically activated, step 128 wherein the throwing machine is controlled using the operating parameters previously set in procedure 100 and step 130 where a sports object is thrown.

Figure 3:
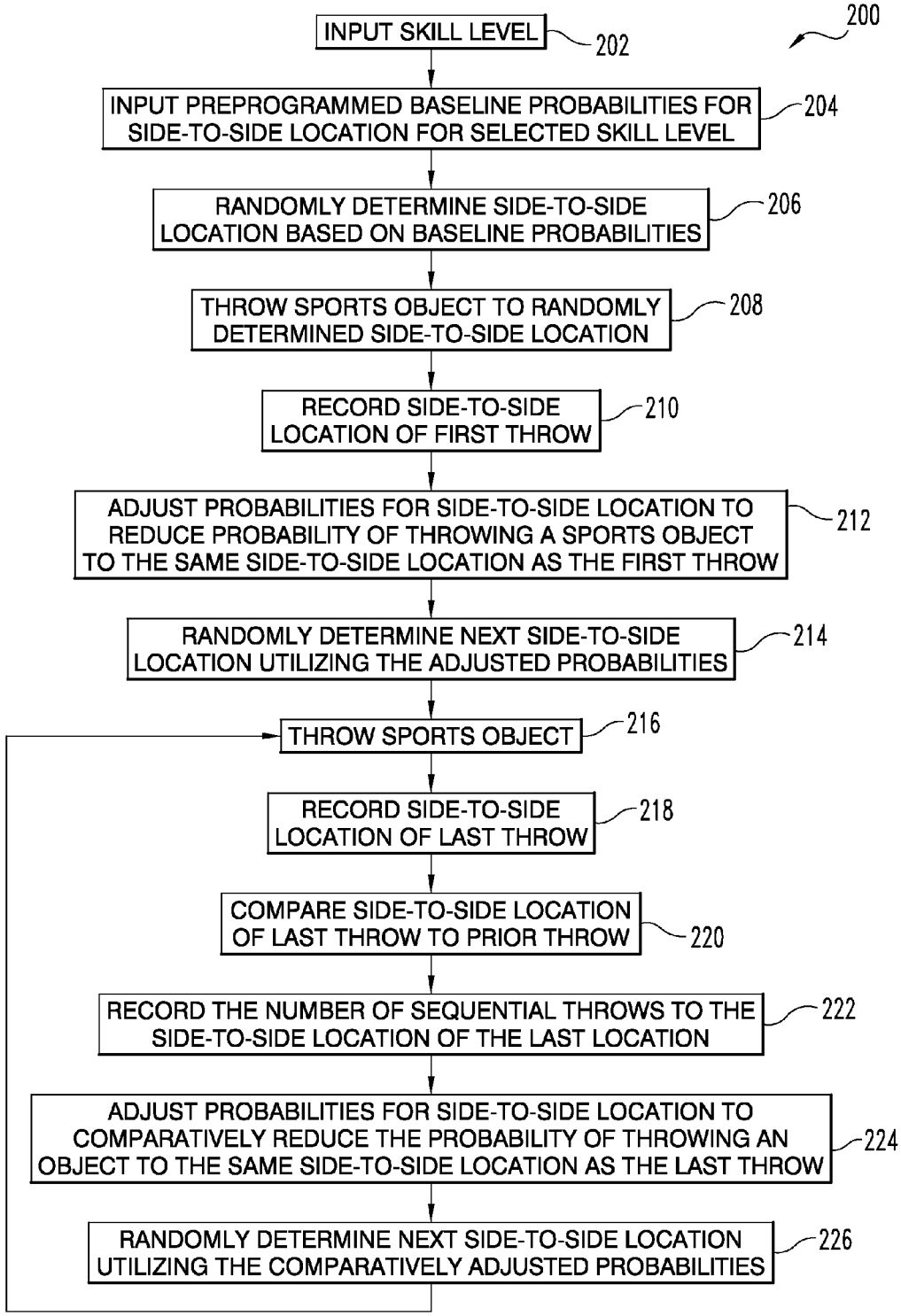
FIG. 3 is a detailed flow diagram of an aspect of the method of the present disclosure.

Turning now to FIG. 3, an embodiment of program 22 running controller 20 is depicted as procedure 200. Procedure 200, in general, adjusts the probability of side-to-side shot distributions based on selected skill level to limit repeated throws to the same location. This is done because in some situations it is desirable to provide a training experience that provides more variation in the location of throws than may be realistic in a competitive situation. In this regard, a weighted distribution of shot pattern based on an average distribution for a particular skill level has the potential to still throw a significant number of shots to the same location. While this may accurately emulate a shot pattern that a player might actually encounter, it does not necessarily provide the best training experience to the participant. In addition, frequently the user of such a sports object throwing device desires not only to practice the sport in question, but in addition to be provided an aerobic workout. In other situations, a player may lose interest in practicing returning shots from the same location repeatedly. Accordingly, procedure 200 provides a means to force the distribution of shots to different locations while still reflecting the shot's distribution pattern reflective of what may be encountered in a competitive situation.

For example, in tennis, one theory of play is called "percentage tennis." Individuals practicing percentage tennis are more concerned with safely returning every ball rather than hitting "winners," as hitting winners is considered a high risk proposition. The basis of this theory is that more shots are lost through unforced errors than are won by hitting unreturnable shots. As a result of this, much of competitive tennis play consists of shots repetitively hit to deep center or near center court. This is especially true of advanced players who have better control over their shot location.

Procedure 200 begins with step 202 where user inputs a skill level preferably via input 24. In step 204, the selected skill level is used to automatically input preprogrammed baseline probabilities for side-to-side throwing positions. Preferably, these preprogrammed baseline probabilities, examples of which are illustrated in Tables 1 and 2 below, reflect distribution probabilities equivalent to that typically encountered in the particular sport when played at the particular skill level. In the preferred embodiment, the distribution probabilities are weighted to favor particular sectors over others so that the resultant shot distribution is pseudo-random. Procedure 200 continues with step 206 where the side-to-side throwing position is randomly determined based on the baseline probabilities inputted in step 204. At step 208, throwing means 16 throws a sports object 12. Step 210 the side-to-side position of the first throwing is recorded. Step 212 the probability for side-to-side position is reset to reduce the probability as compared to the baseline probability of throwing a sports object to the same side-to-side throwing position as the first position. Specific examples of different methods are provided below in FIGS. 5-7. Procedure 200 continues with step 214 wherein the side-to-side throwing position for the next throwing is randomly determined using the adjusted probabilities from step 212. In step 216, a sports object is thrown using the newly determined probabilities from step 214 and in step 218, the side-to-side throwing position of this last throw is recorded. In step 220, a comparison of the side-to-side throwing positions of the last throw and the prior throwing is made. In step 222 the number of shots or throws to the last side-to-side position are recorded. In step 224, further adjustments are made to the side-to-side position distribution for the next throwing to reduce the probability of throwing an object to the same side-to-side position. Procedure 200 continues with step 226 where the next side-to-side throwing position is randomly determined utilizing the comparatively adjusted probabilities determined in step 224. Procedure 200 then returns to step 216 until the procedure 200 is terminated by the device running out of balls or the user interrupting procedure 200 through power interruption or pressing an off button.

Figure 4:
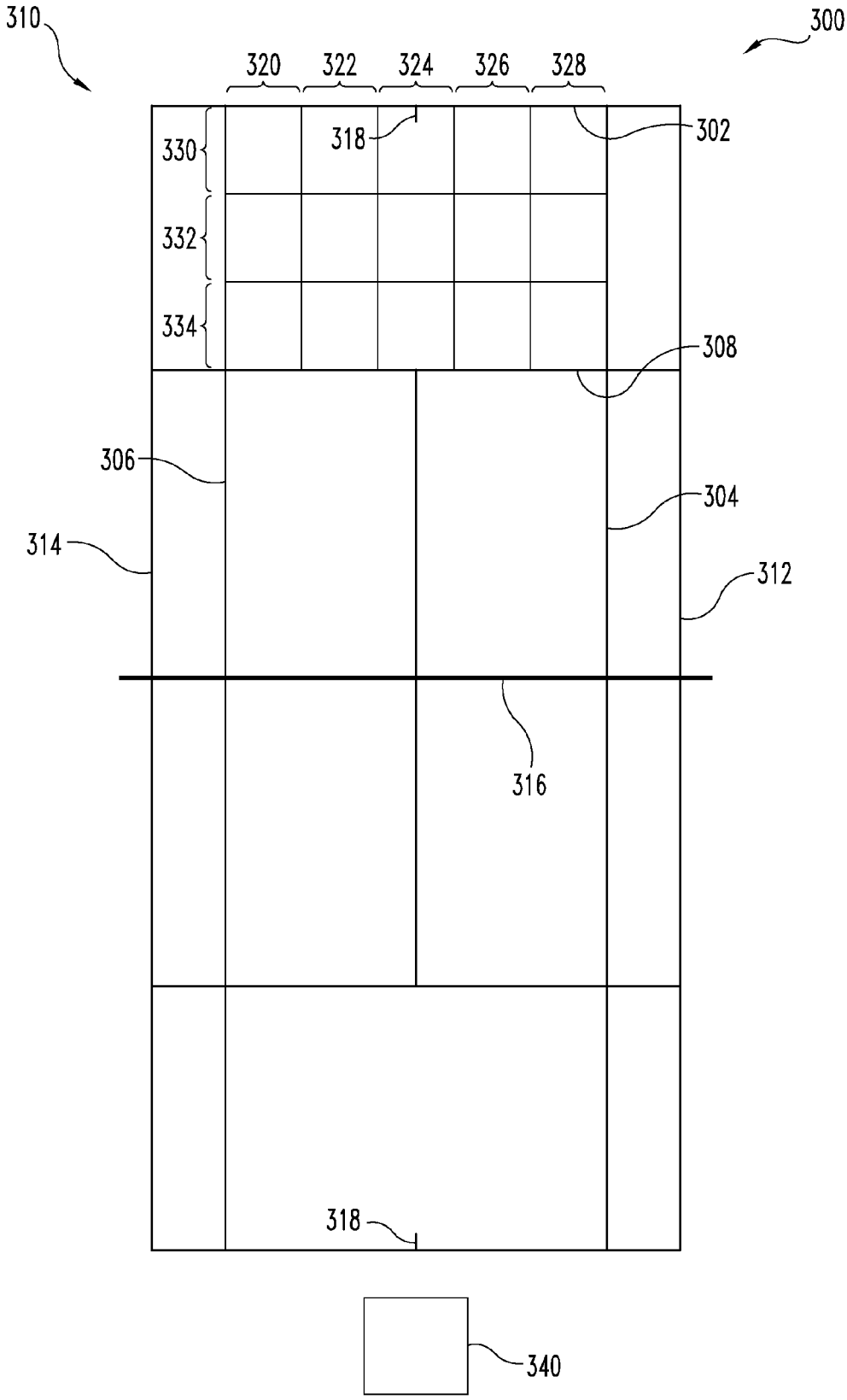
FIG. 4 is a diagram of a tennis court illustrating an aspect of the present disclosure.

In FIG. 4, tennis court 300 is depicted. Tennis court 300 includes baseline 302, right singles sideline 304, left singles sideline 306, service line 308. Baseline 302, right singles sideline 304, left singles sideline 306 and service line 308 define back court 310. Also depicted on tennis court 300 are right double sideline 312, left double sideline 314, net 316 and hash marks 318.

Back court 310 is depicted divided into several distinct regions horizontally and vertically, including horizontal sectors: far left back court 320, near left back court 322, center court 324, near right back court 326 and far right back court 328. Back court 310 is further divided vertically by back portion of back court 330 which is nearest baseline 302, middle portion of back court 332 and nearest portion of back court 334 which is nearest service line 308. This division of the backcourt results in 15 distinct positions in the backcourt. Also depicted on tennis court 300 is tennis ball throwing machine 340. It should be understood that the illustrated position is for example only as tennis ball throwing machine 340 can be located anywhere desired.

It should be understood that the horizontal and vertical sector designations illustrated in FIG. 4 are for example only. It has been determined that for the preferred tennis ball throwing machine utilized herein, a distribution of five horizontal sectors on the back court and three vertical sectors is adequate to account for typical accuracy. Furthermore, the distribution area has been limited to the backcourt, which, in general, is where the majority of shots are returned to in competitive situations. However, this invention is not so limited. It is envisioned that either more or fewer divisions could be utilized to fall within the envisioned scope of this disclosure. In addition, it is envisioned that the distribution area could include any area of the court desired to be utilized for a particular purpose. In particular, it may be advantageous to widen the area utilized to include a zone between the single court and the doubles court, particularly when simulating practice situations for doubles players. It could also be advantageous to include the area in the service box either to simulate a service game or to simulate a greater range of practice shots.

Turning now to Table 1, an embodiment of skill based probabilities for five side-to-side sectors positioning of shots is given. The sectors identified in Table 1 correspond to the sectors defined in FIG. 4. The probabilities shown in Table 1 vary based on the previous shot location and the number of consecutive shots to that location to reduce the number of shots in the same side-to-side sector.

TABLE 1

| Previous Shot Location | Number of Consecutive shots | Skill Level | % Far Left | % Near Left | % Center | % Near Right | % Far Right |
|---|---|---|---|---|---|---|---|
| First shot | 0 | Beginner | 0 | 30 | 40 | 30 | 0 |
| | | Intermediate | 5 | 25 | 40 | 25 | 5 |
| | | Advanced | 10 | 20 | 40 | 20 | 10 |
| Middle | 1 | Beginner | 0 | 34 | 32 | 34 | 0 |
| | | Intermediate | 5.67 | 28.33 | 32 | 28.33 | 5.67 |
| | | Advanced | 11.33 | 22.67 | 32 | 22.67 | 11.33 |
| Middle | 2 | Beginner | 0 | 38 | 24 | 38 | 0 |
| | | Intermediate | 6.33 | 31.67 | 24 | 31.67 | 6.33 |
| | | Advanced | 12.67 | 25.33 | 24 | 25.33 | 12.67 |
| Middle | 3 | Beginner | 0 | 42 | 16 | 42 | 0 |
| | | Intermediate | 7 | 35 | 16 | 35 | 7 |
| | | Advanced | 14 | 28 | 16 | 28 | 14 |
| Middle | 4 | Beginner | 0 | 46 | 8 | 46 | 0 |
| | | Intermediate | 7.67 | 38.33 | 8 | 38.33 | 7.67 |
| | | Advanced | 15.33 | 30.67 | 8 | 30.67 | 15.33 |
| Middle | 5 | Beginner | 0 | 50 | 0 | 50 | 0 |
| | | Intermediate | 8.33 | 41.67 | 0 | 41.67 | 8.33 |
| | | Advanced | 16.67 | 33.33 | 0 | 33.33 | 16.67 |
| Near Left | 1 | Beginner | 0 | 20 | 45.71 | 34.29 | 0 |
| | | Intermediate | 5.56 | 16.67 | 44.44 | 27.78 | 5.56 |
| | | Advanced | 10.83 | 13.33 | 43.33 | 21.67 | 10.83 |
| Near Left | 2 | Beginner | 0 | 10 | 51.43 | 38.57 | 0 |
| | | Intermediate | 6.11 | 8.33 | 48.89 | 30.56 | 6.11 |
| | | Advanced | 11.67 | 6.67 | 46.67 | 23.33 | 11.67 |
| Near Left | 3 | Beginner | 0 | 0 | 57.14 | 42.86 | 0 |
| | | Intermediate | 6.67 | 0 | 53.33 | 33.33 | 6.67 |
| | | Advanced | 12.5 | 0 | 50 | 25 | 12.5 |
| Near Right | 1 | Beginner | 0 | 34.29 | 45.71 | 20 | 0 |
| | | Intermediate | 5.56 | 27.78 | 44.44 | 16.67 | 5.56 |
| | | Advanced | 10.83 | 21.67 | 43.33 | 13.33 | 10.83 |
| Near Right | 2 | Beginner | 0 | 38.57 | 51.43 | 10 | 0 |
| | | Intermediate | 6.11 | 30.56 | 48.89 | 8.33 | 6.11 |
| | | Advanced | 11.67 | 23.33 | 46.67 | 6.67 | 11.67 |
| Near Right | 3 | Beginner | 0 | 42.86 | 57.14 | 0 | 0 |
| | | Intermediate | 6.67 | 33.33 | 53.33 | 0 | 6.67 |
| | | Advanced | 12.5 | 25 | 50 | 0 | 12.5 |
| Far Left | 1 | Intermediate | 2.5 | 25.66 | 41.05 | 25.66 | 5.13 |
| | | Advanced | 5 | 21.11 | 42.22 | 21.11 | 10.56 |
| Far Left | 2 | Intermediate | 0 | 26.32 | 42.11 | 26.32 | 5.26 |
| | | Advanced | 0 | 22.22 | 44.44 | 22.22 | 11.11 |
| Far Right | 1 | Intermediate | 5.13 | 25.66 | 41.05 | 25.66 | 2.5 |
| | | Advanced | 10.56 | 21.11 | 42.22 | 21.11 | 5 |
| Far Right | 2 | Intermediate | 5.26 | 26.32 | 42.11 | 26.32 | 0 |
| | | Advanced | 11.11 | 22.22 | 44.44 | 22.22 | 0 |

Turning now to Table 2, an embodiment of skill-based probabilities for depth of shot positioning of shots is given. Included are three individual vertical or depth sectors corresponding to the sectors defined in FIG. 4.

TABLE 2

| | Depth Probabilities | | |
|---|---|---|---|
| | Baseline | Middle | Closest |
| Beginner | 75 | 20 | 5 |
| Intermediate | 80 | 15 | 5 |
| Advanced | 85 | 10 | 5 |

Figure 5:
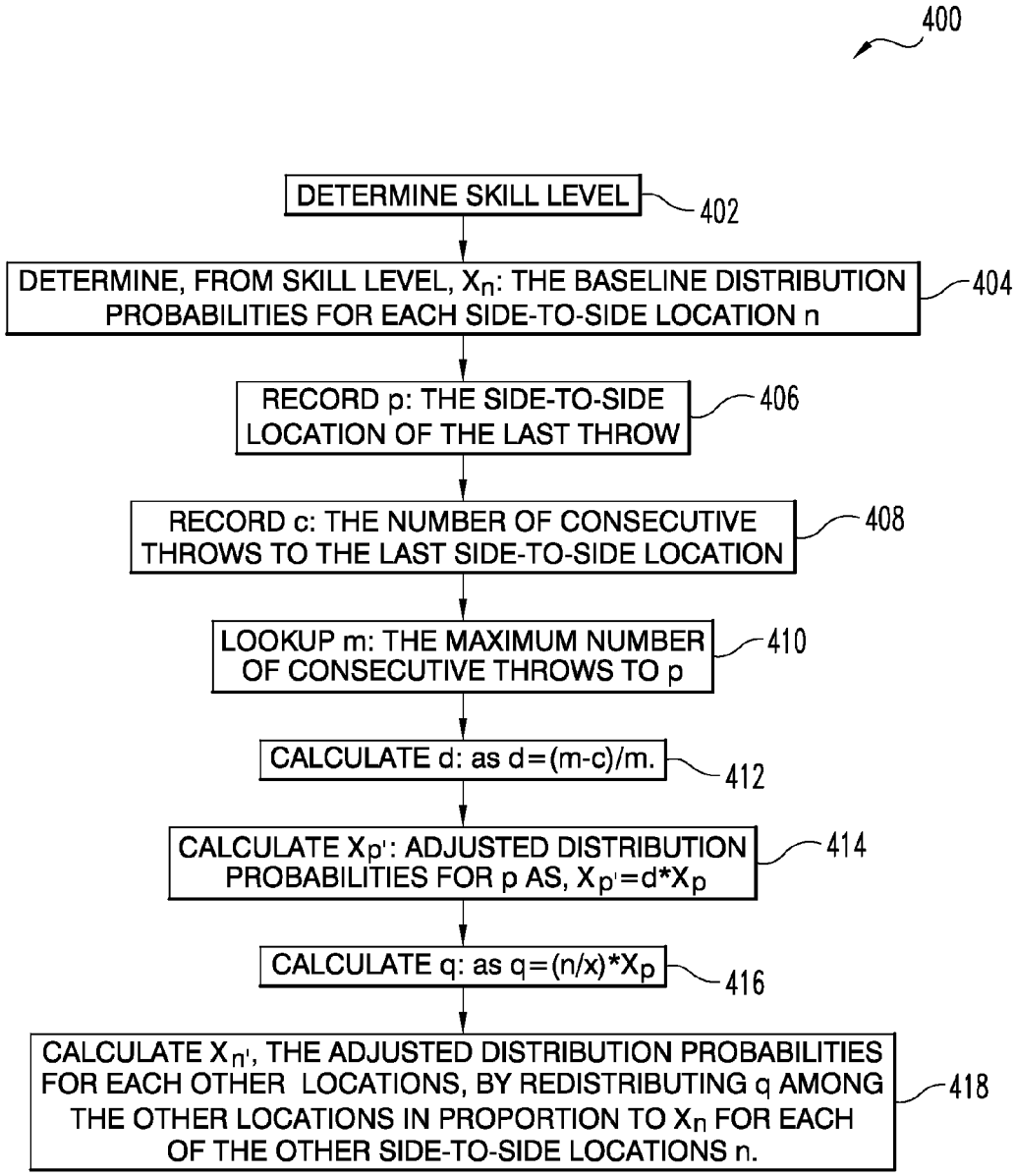
FIG. 5 is a detailed flow diagram of an aspect of the method of the present disclosure.

Turning now to FIG. 5 an embodiment of step 224 from procedure 200 is illustrated as procedure 400. Procedure 400 begins with step 402 where the skill level is determined, preferably through user input. Procedure 400 continues with step 404 where baseline distribution probability for each side-to-side throwing sector n, $X_n$, is determined on the basis of skill level. As one nonlimiting example, this could be done through a look-up table looking up the data similar to that illustrated in Table 1. Procedure 400 continues with step 406 where the side-to-side sector of the last throw, p, is recorded.

In step 408, the number of consecutive throws to the last side-to-side sector, c, is recorded. In step 410, the maximum number of consecutive throws to p, or m, is determined through a look-up table or a variable setting. In step 412, d, or the percentage to reduce the probability of throwing, is calculated using Equation 1 as follows.

$$d = \frac{m - c}{m} \tag{1}$$

In step 414, the adjusted distribution probability for p, $X_{p'}$, is calculated using Equation 2 as follows. $X_p$ is the baseline distribution probability of sector p.

$$X_{p'} = X_p * d \tag{2}$$

In step 416, q, or the relative amount by which the distribution probability has been reduced, is calculated using Equation 3 as follows.

$$q = \frac{n}{x} * X_p \tag{3}$$

Finally, in step 418, the adjusted distribution probabilities for each other throwing sector, $X_{n'}$, is calculated by redistributing q among the other throwing sectors in proportion to the respective baseline distribution probabilities, $X_n$, for each of the other side-to-side throwing sectors. Equation 4 details one method of redistribution utilized herein.

$$X_{n'} = X_n + \frac{X_n}{100 - X_p} * q \tag{4}$$

Figure 6:
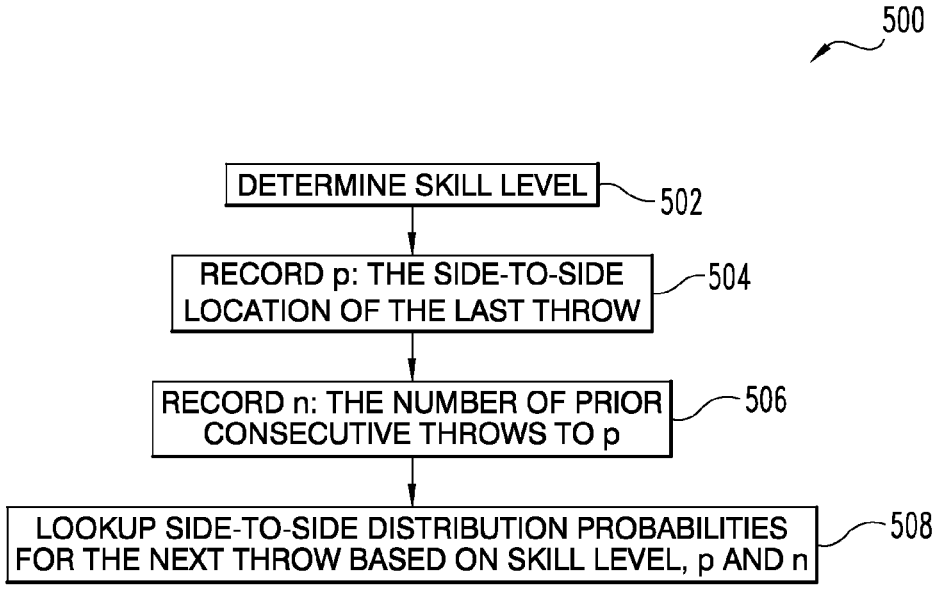
FIG. 6 is a detailed flow diagram of an aspect of the method of the present disclosure.

Turning now to FIG. 6, procedure 500 is depicted in flow chart form. Procedure 500 is another embodiment of step 224 in procedure 200. Procedure 500 begins with step 502 where the skill level is determined. Next the side-to-side sector of the last throw, p, is recorded in step 504. In step 506, the number of prior consecutive throws to p is recorded as n. Finally, at step 508, the side-to-side distribution probability for the next throwing is determined using a look-up table on the basis of skill level p and n. One example of such a look-up table is that presented in Table 1.

Comparing procedure 400 and 500, both are embodiments of step 224. The end result of either could be the same, so long as the equations detailed in procedure 400 are used to calculate the values in the look-up table of procedure 500. However, based on the amount of memory available or the processor speed of the controller, one procedure may be more advantageous than the other, as would be apparent to one of ordinary skill in the art.

Figure 7:
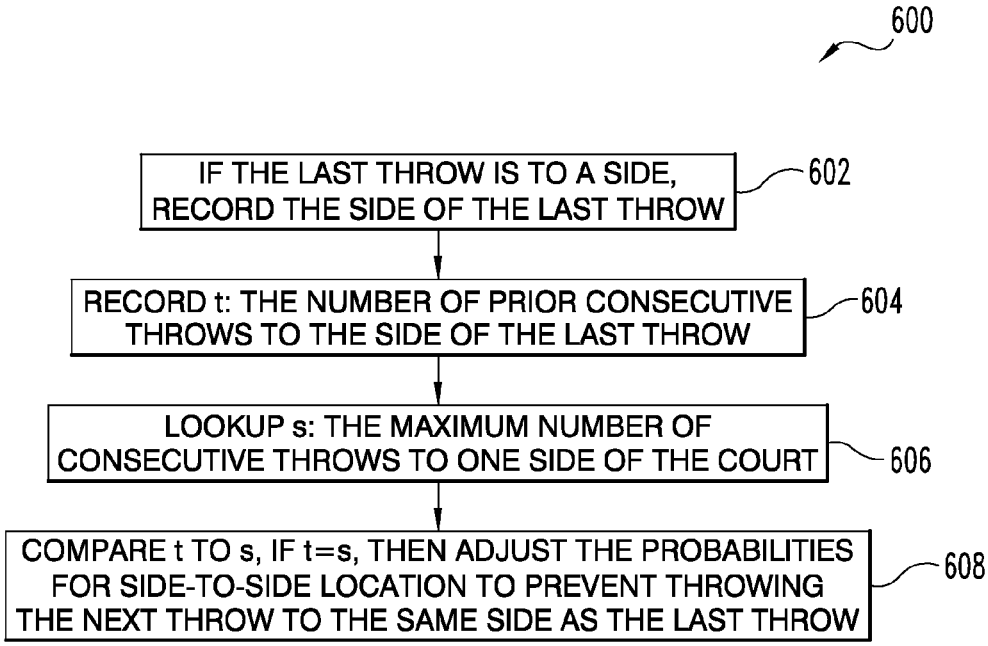
FIG. 7 is a detailed flow diagram of an aspect of the method of the present disclosure.

Turning now to FIG. 7, procedure 600 is illustrated. Procedure 600 begins with step 602 where the side of the last throw is recorded. By way of example in the context of the prior disclosure as it relates to tennis court 300, "side" refers to near right or left and far right or left, but not "center." Of course, the definition of "side" is specific to a particular application and configuration. Procedure 600 continues with step 604 wherein the number of prior consecutive throws to the same side as the last throw is recorded as t. Next, in step 606, the maximum number of consecutive throws to one side of the court is looked up as s. Finally, at step 608, t is compared to s. If t and s are equal, then the probability for the side-to-side sector is adjusted to prevent the next throwing from being on the side of the last throw.

Figure 8:
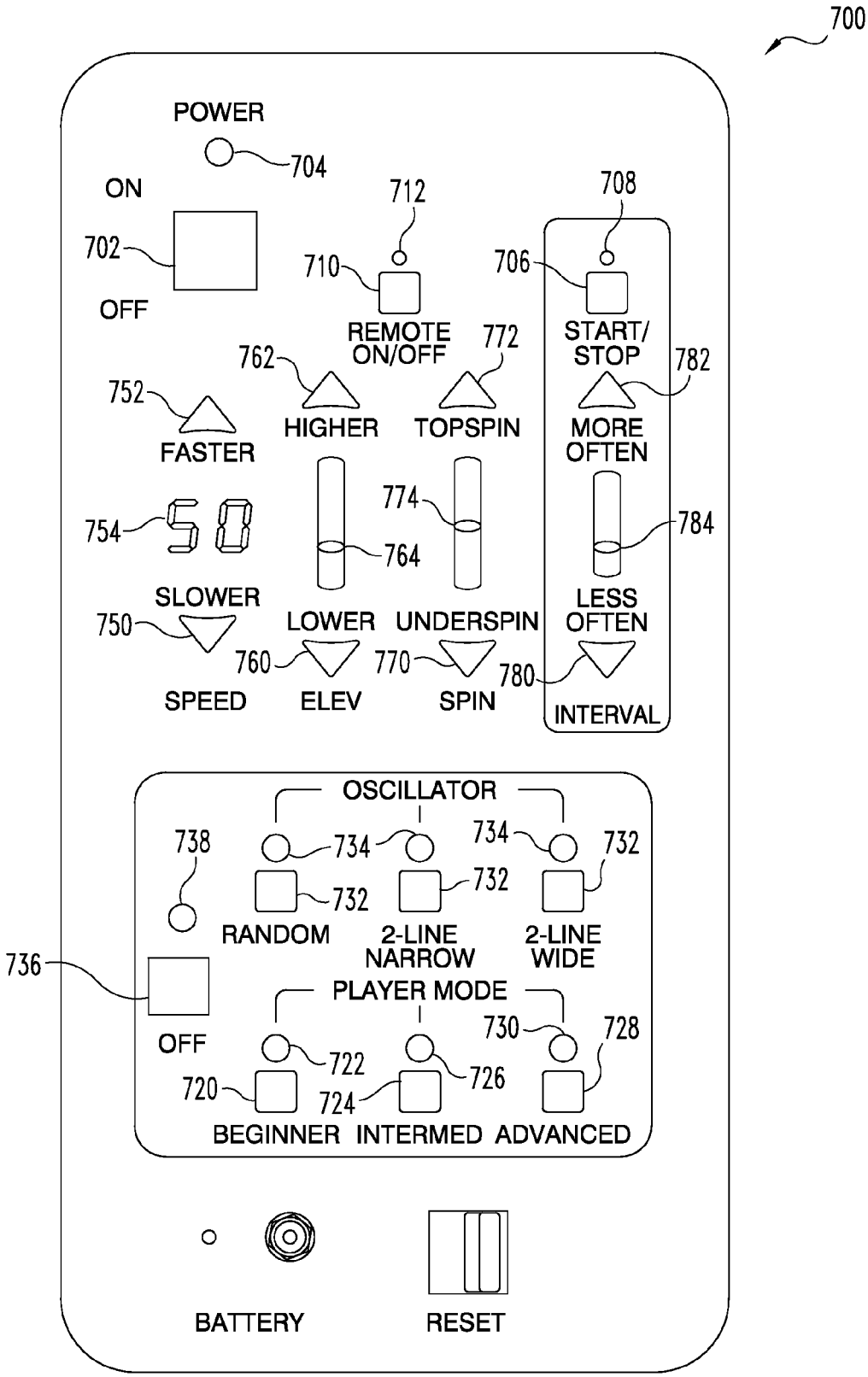
FIG. 8 is an illustration of an embodiment of the control inputs for the system of the present disclosure.

Turning now to FIG. 8, an embodiment of controller input 24, selectors 26 and display 28 are illustrated as controller faceplate 700. Controller faceplate 700 comprises a series of selector switches and indicators as follows including power selector 702 and indicator light 704, interval start/stop selector 706 and indicator light 708, remote control on/off selector 710 and indicator light 712, beginner skill level selector 720, indicator light 722, intermediate skill level selector 724, indicator light 726, advanced skill level selector 728, indicator light 730, oscillation selector 732 and indicator light 734 and shot pattern off selector 736 and indicator light 738. Indicator lights 704, 708, 712, 722, 726, 730, 734 and 738 are all illustrated as LED illuminated areas. However, any form of indicator light is envisioned within the scope of the disclosure herein.

Controller faceplate 700 also includes speed slower selector 750, speed faster selector 752 and indicator display 754. In the present embodiment, indicator display 754 comprises a two-digit LED number read out.

Controller faceplate 700 also includes elevation lower selector 760, elevation higher selector 762, indicator scale 764, under spin selector 770, top spin selector 772 and indicator scale 774. Interval less often selector 780, interval more often selector 782, and indicator scale 784. In the illustrated embodiment, indicator scale 764, 774 and 784 individually comprise a plurality of LED bars stacked on top of each other wherein one of the plurality of bars is illuminated to indicate the respective setting of the individual selector. As would be appreciated by one skilled in the art and controller faceplate 700 can comprise a combination of different selector means such as physical toggle switches, keys, push buttons, rocker switches, microswitches, or any other selector means known to those skilled in the art including a touch screen. Similarly, the indication means disclosed in controller faceplate 700 comprises different forms of LED displays. Any method or form of indicator display or display device known to those skilled in the art is envisioned within the scope of the present disclosure.

In the preferred embodiment, the features and details described above function as follows. The user would first set up the throwing apparatus in an appropriate location such as a sports court and then load the throwing apparatus with whatever sports object is to be thrown. Then the user would select a skill level. The throwing apparatus then would throw a single sports object to a predefined location, such as deep center in the embodiment described in FIG. 4. The user could then verify that the throwing apparatus is performing adequately. If the user determines that the throwing does not travel to the desired location, then the user could manually adjusts one or more parameters, including physically relocating the throwing equipment to correct the error. The throwing apparatus then beings throwing sports objects utilizing preprogrammed parameters without any additional user input or effort. However, if desired, the user could manually adjust one or more parameter to adjust the performance parameters of the throwing to fit their requirements. However, preferably, any parameter not manually adjusted would retain the preprogrammed parameters of operation.

Further regarding manual adjustment of elevation, if the user adjusts the elevation after selecting a skill level, then the user selected elevation becomes the baseline (deep) position for operation and two shots are made at the selected elevation before weighted random movement resumes. This provides a means for the user to adjust the depth of shot based on varying conditions such as wind, wear on the throwing equipment or sports objects, and location of the throwing equipment.

Further details of the preferred embodiment include centering the horizontal movement mechanism if shot pattern off selector 736 is selected. If the operating parameters of speed, spin, feed rate or elevation are changed after a skill level is selected, then those user settings are retained until a new skill level is selected. In addition, selecting the skill level that has already been selected resets the operating parameters to the predefined values, discarding any user adjustments to the settings.

Another detail of the preferred embodiment is that if the feed rate is set such that the throwing apparatus cannot complete a traverse from a first shot location to the next shot location, then the throwing apparatus will throw balls as called for by the feed rate while traversing to the next shot location called for by the weighted random distribution programmed in the controller. The controller will not determine a next shot location until the previous shot that was called for is actually made.

While the disclosure has been illustrated and described in detail in the drawings and foregoing description, the same is to be considered as illustrative and not restrictive in character, it being understood that only selected embodiments have been shown and described and that all equivalents, changes, and modifications that come within the spirit of the disclosures as defined herein or by the following claims are desired to be protected.

What is claimed is:

1. An apparatus for throwing sports objects comprising:

a throwing machine; and a controller that controls the location of throws by the throwing machine, wherein the probability of a throw being made to a particular location is affected by the randomly selected location of a prior throw.

2. The apparatus of claim 1, wherein the probability of a throw being made to a particular location is also affected by the number of consecutive throws to the randomly selected location of the prior throw.

3. The apparatus of claim 1, wherein the probability of a throw being made to a particular location is affected by a weighted random selection, wherein the apparatus includes a skill level selector that affects the weighting of the random selection.

4. The apparatus of claim 1, further comprising:

a skill level selector; and a plurality of preprogrammed probabilities for determining the location of throws by the throwing machine, wherein each of the plurality of preprogrammed probabilities correspond to the skill levels selectable by the selector, wherein the probability of a throw being made to a particular location is affected by the selected skill level and the corresponding probabilities for determining the location of throws by the throwing machine.

5. A method of operating a sports object throwing machine comprising the steps of:

a) providing a sports object throwing machine comprising:

a throwing machine having operating parameters;

a controller that controls the operating parameters of the throwing machine;

a skill level selector; and a plurality of preprogrammed throw distribution patterns, wherein each of the plurality of different preprogrammed throw distribution patterns correspond to skill levels selectable by the selector;

b) selecting a skill level with the skill level selector;

c) upon the selection of the skill level, automatically setting within the controller the throw distribution pattern which corresponds to the selected skill level;

d) wherein the sports object throwing machine additionally includes:

a plurality of preprogrammed throw distribution patterns, wherein each of the plurality of distribution patterns correspond to skill levels selectable by the selector and the location of the last throw;

e) providing a plurality of sports objects;

f) throwing one of the sports objects;

g) upon throwing of one of the sports objects, recording the location of the last throw; and h) after throwing of one of the sports objects, within the controller, automatically resetting the operating parameter of throw distribution pattern to the throw distribution pattern that corresponds to both the selected skill level and the location of the last throw.

6. A method of operating a sports object throwing machine comprising the steps of:

a) providing a sports object throwing machine comprising:

a throwing machine having operating parameters;

a controller that controls the operating parameters of the throwing machine;

a skill level selector; and a plurality of preprogrammed throw distribution patterns, wherein each of the plurality of different preprogrammed throw distribution patterns correspond to skill levels selectable by the selector;

b) selecting a skill level with the skill level selector;

c) upon the selection of the skill level, automatically setting within the controller the throw distribution pattern which corresponds to the selected skill level;

d) wherein the sports object throwing machine additionally includes:

a plurality of preprogrammed throw distribution patterns, wherein each of the plurality of distribution patterns correspond to skill levels selectable by the selector, the location of the last throw, and the number of sequential throws to the location of the last throw;

e) providing a plurality of sports objects;

f) throwing one of the sports objects;

g) upon the throwing of one of the sports objects, recording the location of the last throw;

h) upon the throwing of one of the sports objects, recording the number of sequential throws to the location of the last throw; and i) after throwing of one of the sports objects, within the controller, automatically resetting within the controller the throw distribution pattern which corresponds to the selected skill level, the location of the last throw and the number of sequential throws to the location of the last throw.

7. A method of operating a sports object throwing machine comprising the steps of:

a) providing a sports object throwing machine comprising:

a throwing machine having operating parameters;

a controller that controls the operating parameters of the throwing machine;

a skill level selector; and a plurality of preprogrammed throw distribution patterns, wherein each of the plurality of different preprogrammed throw distribution patterns correspond to skill levels selectable by the selector;

b) selecting a skill level with the skill level selector;

c) upon the selection of the skill level, automatically setting within the controller the throw distribution pattern which corresponds to the selected skill level;

d) providing a plurality of sports objects;

e) throwing one of the sports objects;

f) upon the throwing of one of the sports objects, recording the side-to-side position of the last throw; and g) after throwing of one of the sports objects, adjusting the operating parameter of throw distribution pattern to reduce the probability of throwing the next sports object to the same side-to-side position as the last throw.

8. A method of operating a sports object throwing machine comprising the steps of:

a) providing a sports object throwing machine comprising:

a throwing machine having operating parameters;

a controller that controls the operating parameters of the throwing machine;

a skill level selector; and a plurality of preprogrammed throw distribution patterns, wherein each of the plurality of different preprogrammed throw distribution patterns correspond to skill levels selectable by the selector;

b) selecting a skill level with the skill level selector;

c) upon the selection of the skill level, automatically setting within the controller the throw distribution pattern which corresponds to the selected skill level, wherein the operating parameter of throw distribution pattern includes a weighted random side-to-side distribution of shots.

9. The method of claim 8, further comprising the steps of:

d) tracking the side-to-side position of previous throws; and e) automatically adjusting the set distribution pattern to reduce the probability of the next throw being thrown to the side-to-side position of the immediately previous throw.

10. The method of claim 9, further comprising the steps of:

f) tracking the number of consecutive throws to the side-to-side position of the previous throw; and g) automatically adjusting the set distribution pattern to prevent the next throw from being thrown to the side-to-side position of the previous shot if the number of consecutive throws to the side-to-side position of the previous throw exceed a preprogrammed number.

11. A method of operating a sports object throwing machine comprising the steps of:

a) providing a sports object throwing machine comprising:

a throwing machine having operating parameters;

a controller that controls the operating parameters of the throwing machine;

a skill level selector; and a plurality of preprogrammed throw distribution patterns, wherein each of the plurality of different preprogrammed throw distribution patterns correspond to skill levels selectable by the selector;

b) selecting a skill level with the skill level selector;

c) upon the selection of the skill level, automatically setting within the controller the throw distribution pattern which corresponds to the selected skill level, wherein the operating parameter of throw distribution pattern includes a weighted random vertical distribution of shots.

12. The method of claim 11, further comprising the step of:

d) providing a sports object throwing machine further comprising:

a plurality of preprogrammed operating parameters each corresponding to skill levels selectable by the selector, wherein the operating parameters include a throw speed, a throw elevation, a throw spin rate and a throw rate; and e) upon the selection of the skill level, automatically setting within the controller the operating parameters of throw speed, throw elevation, throw spin rate and throw rate which correspond to the selected skill level.

13. A method of operating a sports object throwing machine comprising the steps of:

a) providing a sports object throwing machine comprising:

a throwing machine having operating parameters;

a controller that controls the operating parameters of the throwing machine;

a skill level selector; and a plurality of preprogrammed throw distribution patterns, wherein each of the plurality of different preprogrammed throw distribution patterns correspond to skill levels selectable by the selector;

b) selecting a skill level with the skill level selector;

c) upon the selection of the skill level, automatically setting within the controller the throw distribution pattern which corresponds to the selected skill level, wherein the throwing machine is a tennis ball machine and the throw distribution pattern includes five side-to-side sectors and three vertical sectors.

14. The method of claim 13, further comprising the step of:

d) providing a sports object throwing machine further comprising:

a plurality of preprogrammed operating parameters each corresponding to skill levels selectable by the selector, wherein the operating parameters include a throw speed, a throw elevation, a throw spin rate and a throw rate; and e) upon the selection of the skill level, automatically setting within the controller the operating parameters of throw speed, throw elevation, throw spin rate and throw rate which correspond to the selected skill level.

15. A method of operating a sports object throwing machine comprising the steps of:

a) providing a sports object throwing machine comprising:

a throwing machine having operating parameters;

a controller that controls the operating parameters of the throwing machine;

a skill level selector; and a plurality of preprogrammed throw distribution patterns, wherein each of the plurality of different preprogrammed throw distribution patterns correspond to skill levels selectable by the selector;

b) selecting a skill level with the skill level selector;

c) upon the selection of the skill level, automatically setting within the controller the throw distribution pattern which corresponds to the selected skill level, wherein the throw distribution pattern includes preprogrammed probabilities for five side-to-side sectors including a far right sector, a near right sector, a center sector, a near left sector and a far left sector;

wherein the probability of the center sector being selected is greater than the probability of any other sector being selected.

16. A method of operating a sports object throwing machine comprising the steps of:

a) providing a sports object throwing machine comprising:

a throwing machine having operating parameters;

a controller that controls the operating parameters of the throwing machine;

a skill level selector; and a plurality of preprogrammed throw distribution patterns, wherein each of the plurality of different preprogrammed throw distribution patterns correspond to skill levels selectable by the selector;

b) selecting a skill level with the skill level selector;

c) upon the selection of the skill level, automatically setting within the controller the throw distribution pattern which corresponds to the selected skill level, wherein the throw distribution pattern includes preprogrammed probabilities for three vertical sectors including a furthest sector, a middle sector and a nearest sector;

wherein the probability of the furthest sector being selected is substantially greater than the probability of any other sector being selected.

17. An apparatus for throwing sports objects, the apparatus comprising:

a sports object throwing apparatus having operating parameters;

a controller that controls the location of throws by the sports object throwing apparatus;

a selector for selecting a skill level; and a plurality of preprogrammed probabilities for controlling the location of throws by the sports object throwing apparatus, wherein each of the plurality of preprogrammed probabilities correspond to individual skill levels selectable by the selector, wherein upon the selection of the skill level, the probabilities for controlling the location of throws by the sports object throwing apparatus corresponding to the selected skill level are automatically set in the controller.

18. The apparatus of claim 17, wherein the preprogrammed probabilities for controlling the location of throws by the sports object throwing apparatus for a given skill level are factory preset and are not user adjustable.

19. The apparatus of claim 17, wherein the preprogrammed probabilities for controlling the location of throws by the sports object throwing apparatus includes a weighted random side-to-side distribution of throws.

20. The apparatus of claim 19, wherein the controller tracks the side-to-side position of previous throws and the preprogrammed probabilities for controlling the location of throws by the sports object throwing apparatus are automatically adjusted by the controller to reduce the probability of a subsequent throw being thrown to the side-to-side position of the immediately previous throw.

21. The apparatus of claim 19, wherein after a preset number of sequential throws to the same side-to-side position, the probability for controlling the location of throws by the sports object throwing apparatus to the same side-to-side position is automatically adjusted by the controller to prevent the next throw from being thrown to that same side-to-side position.

22. The apparatus of claim 17, wherein the preprogrammed probabilities for controlling the location of throws by the sports object throwing apparatus includes a weighted random vertical distribution of throws.

23. The apparatus of claim 17, wherein the preprogrammed probabilities for controlling the location of throws by the sports object throwing apparatus includes both a weighted random side-to-side distribution of throws and a weighted random vertical distribution of throws, wherein the side-to-side location of the next throw is determined independently of the vertical location of the next throw.

24. The apparatus of claim 17, wherein the operating parameters include a throw speed, a throw elevation, a throw spin rate, and a throw rate, wherein the controller includes a plurality of preprogrammed operating parameters for throw speed, throw elevation, throw spin rate, and feed rate, wherein each of the plurality of preprogrammed probabilities correspond to individual skill levels selectable by the selector, wherein upon the selection of the skill level, the operating parameters for throw speed, throw elevation, throw spin rate and throw rate are automatically set.

25. The apparatus of claim 24, further comprising:

a throw speed selector, wherein the throw speed set by the selection of the skill level can be increased or decreased by the throwing speed selector.

26. The apparatus of claim 24, further comprising:

a throw elevation selector, wherein the throw elevation set by the selection of the skill level can be increased or decreased by the throwing elevation selector.

27. The apparatus of claim 24, further comprising:

a throw spin selector, wherein the throw spin set by the selection of the skill level can be increased or decreased by the throw spin selector.

28. The apparatus of claim 24, further comprising:

a throw rate selector, wherein the throw rate set by the selection of the skill level can be increased or decreased by the throw rate selector.

29. A ball-throwing machine for throwing tennis balls consisting essentially of:

a tennis ball throwing mechanism having adjustments for throwing elevation and horizontal angle;

a skill level selector operable for a user to select one of a plurality of skill levels; and a controller operable to control the throwing elevation and horizontal angle, said controller being programmed with standard probability parameters for throwing elevation and horizontal angle for each of the plurality of skill levels, wherein upon selection of one of the plurality of skill levels by the user, the controller sets the parameters of throwing elevation and horizontal angle on the basis of the standard programmed probability parameters corresponding to the selected skill level.

* * * * *